United States Patent [19]

Dicks

[11] 4,300,441

[45] Nov. 17, 1981

[54] BASEBOARD DISTRIBUTION HOT AIR HEATING SYSTEM

[76] Inventor: Robert H. Dicks, Rte. 3, Box 433A, Lodi, Wis. 53555

[21] Appl. No.: 89,918

[22] Filed: Oct. 31, 1979

[51] Int. Cl.[3] ..... F24F 13/02

[52] U.S. Cl. ..... 98/40 C; 98/103

[58] Field of Search ..... 98/2.05, 2, 40 R, 40 C, 98/40 N, 36, 103; 138/114, 155

[56] References Cited

U.S. PATENT DOCUMENTS

| | | | |
|---|---|---|---|
| 425,601 | 4/1890 | Eversman et al. | 138/114 X |
| 2,395,233 | 2/1946 | Richardson | 98/40 C |
| 2,741,970 | 4/1956 | Howell | 98/40 C |
| 2,742,845 | 4/1956 | Simpson | 98/40 C |
| 2,824,575 | 2/1958 | Rosen | 98/40 C X |
| 3,768,549 | 10/1973 | Goodie | 98/40 C X |
| 4,109,563 | 8/1978 | Schleicher | 98/40 C |

*Primary Examiner*—Albert J. Makay
*Assistant Examiner*—Harold Joyce
*Attorney, Agent, or Firm*—Charles S. McGuire

[57] ABSTRACT

One or more ducts conduct hot air from a central heating plant to a baseboard distribution system in a room or other space to be heated. The baseboard unit forms an enclosed space through which a conduit extends longitudinally at approximately the horizontal centerline. The conduit and baseboard each include a plurality of laterally spaced openings through which heat may escape, those in the baseboard being at or near floor level, whereby the hot air escaping from the conduit fills the upper portion of the baseboard enclosure before passing through the lower level openings into the room. The baseboard enclosure thus serves as a reservoir for hot air, avoiding abrupt changes in temperature usually associated with forced hot air heating systems.

7 Claims, 9 Drawing Figures

BASEBOARD DISTRIBUTION HOT AIR HEATING SYSTEM

BACKGROUND OF THE INVENTION

The present invention relates to hot air heating systems and, more specifically, to novel baseboard distribution units for use in forced hot air space heating systems.

Among the most popular space heating systems are those wherein a supply of air heated at a central location is conducted to the rooms or other spaces to be heated via appropriate ductwork. While such systems are effective for moving relatively large volumes of heated air quickly to the space being heated, particularly those of the forced hot air type, they are often characterized by relatively large and rapid fluctuation in ambient temperature, and/or by frequent on-off cycles of the burner and circulating fan(s). Since the heated air is discharged through floor, wall, or overhead registers, the areas nearest the registers will obviously be heated more rapidly than more remote areas of the room. Thus, heat distribution is uneven and therefore inefficient.

A curtain of warm air around the outside walls of a structure can provide an effective thermal barrier against entry of outside cold air. Present forced hot air systems, however, being essentially localized in the delivery of warm air do not provide such a barrier. Hydromic systems currently available provide a more effective thermal barrier, but are more expensive to install and are more subject to structural damage, such as leaks or frozen pipes, than forced hot air system. For structures already equipped with forced hot air systems, the cost of conversion to a hydromic system is normally too high to justify the offsetting in heating efficiency.

It is a principal object of the present invention to provide a system for distributing hot air for space heating purposes in a more efficient and economical manner.

A further object is to provide a forced hot air space heating system having components which may be installed and used in conjunction with an already existing central heating plant and ductwork.

Another object is to provide a forced hot air heating system wherein warm air is distributed evenly about the outside walls to form an efficient thermal barrier.

A still further object is to provide a hot air distribution system which supplies hot air to form a thermal barrier around outside walls without requiring more ductwork than a conventional forced hot air heating system.

Still another object is to provide a forced hot air distribution system of superior efficiency which is relatively inexpensive and easy to install.

Other objects will in part be obvious and will in part appear hereinafter.

SUMMARY OF THE INVENTION

In furtherance of the foregoing objects, the hot air distribution system of the invention comprises a heat manifold in the nature of a baseboard unit preferably extending along at least each outside wall of the space to be heated. The heat manifold forms an enclosure of greater vertical than horizontal dimension having a conduit of considerably smaller cross section extending longitudinally therethrough, preferably about halfway up the enclosure. A reducing adapter connects the conventional heat duct to the smaller cross section conduit.

Heated air delivered from the duct to the conduit flows through slots spaced along the lower side of the conduit into the enclosed space of the heat manifold. The heated air initially flows to the top of the enclosed manifold, forcing out lower temperature air through a series of spaced opening along the lower side of the enclosure through which the interior of the manifold communicates with the space to be heated. As the temperature within the manifold becomes essentially equally distributed, the air passing into the space being heated will be approximately at the temperature of the air supplied through the duct. This air will tend to rise along the adjacent wall forming an effective thermal barrier and heating the space, in effect, from the outside in.

Also disclosed are means for joining and terminating modular sections of the baseboard distribution unit as well as routing around doors or other openings in the walls along which the units extend.

DETAILED DESCCRIPTION

Figure 1:
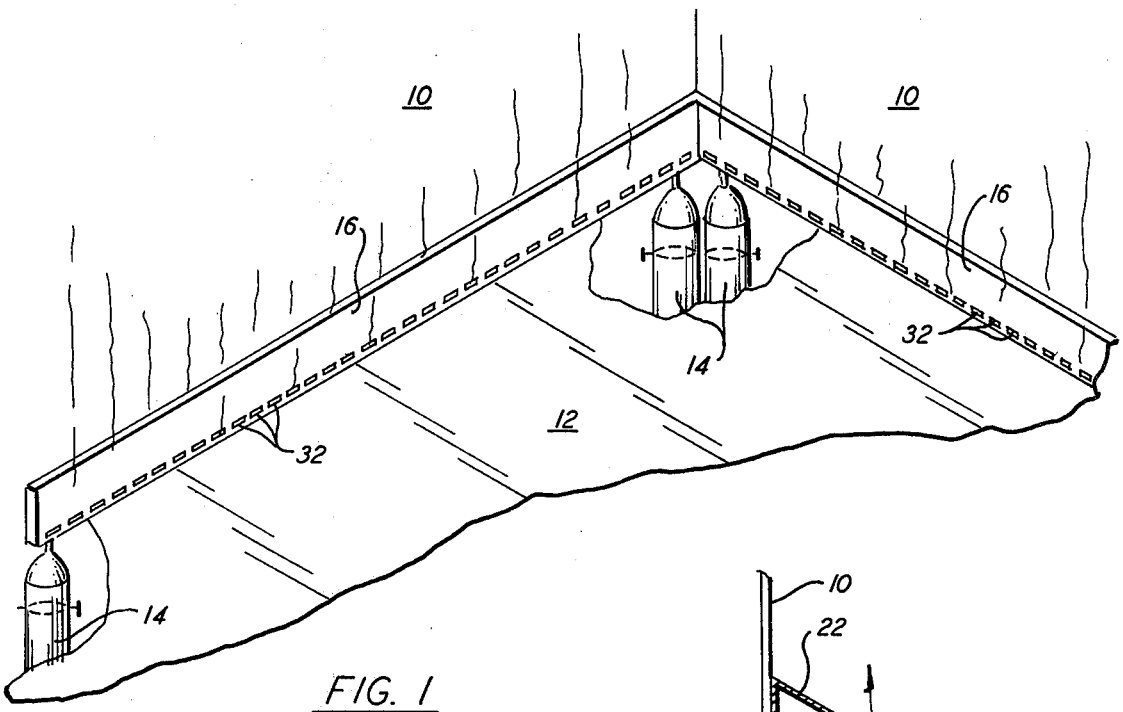
FIG. 1 is a fragmentary, perspective view of a room wherein the hot air distributing system of the invention is installed.

Referring now to the drawings, in FIG. 1 is shown a portion of a room enclosed by walls 10, floor 12 and appropriate ceiling and additional walls to complete the enclosure. Beneath floor 12 are heat ducts 14 which communicate at one end with the hot air chamber of a furnace or other such central heating plant (not shown) for the structure of which the illustrated wall and floor are part. Ducts 14 are assumed to be portions of a conventional forced hot air heating system with which the structure is provided, normally extending to registers or other such outlets in the floor or walls of the room to be heated. The number and location of ducts 14 is thus in accordance with conventional practise and not affected by employment of the present invention.

Figure 3:
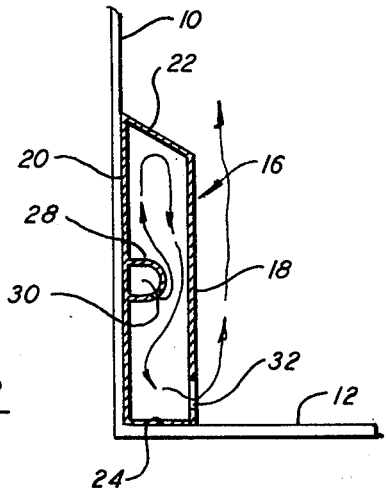
FIG. 3 is a side elevational view in section on the line 3—3 of FIG. 2.

Extending along each of walls 10, and preferably along at least all outside walls of the spaces to be heated, are heat distribution units each including a manifold 16, formed as hollow enclosures installed at floor and wall junctions in the nature of baseboard units. Manifolds 16, as seen more clearly in FIGS. 2 and 3, include front and rear walls 18 and 20, respectively, top and bottom walls 22 and 24, respectively, the vertical dimension preferably being substantially greater than the horizontal in the installed position. Manifolds 16 are provided in standard lengths, joined end-to-end as explained later in more detail, and cut-off as necessary to fit the length of the wall along which installed. Terminating units, i.e., those at the end of a row of such units, include an end wall 26 as shown in FIG. 2.

Extending approximately the entire length of each section of manifolds 16 is enclosed conduit 28. In the illustrated embodiment, conduit 28 is attached to the inner side of rear wall 20 about midway along the vertical dimension thereof. Conduit 28 is of smaller horizontal dimension than the interior of manifold 16, providing ample clearance between the front of conduit 28 and the inner side of front wall 18. Openings in the form of horizontally elongated slots 30 are spaced along the length of conduits 28. Likewise, openings 32 are formed in front wall 18 of manifolds 16 near the lower edge thereof, i.e., adjacent floor level in the installed condition.

Figure 2:
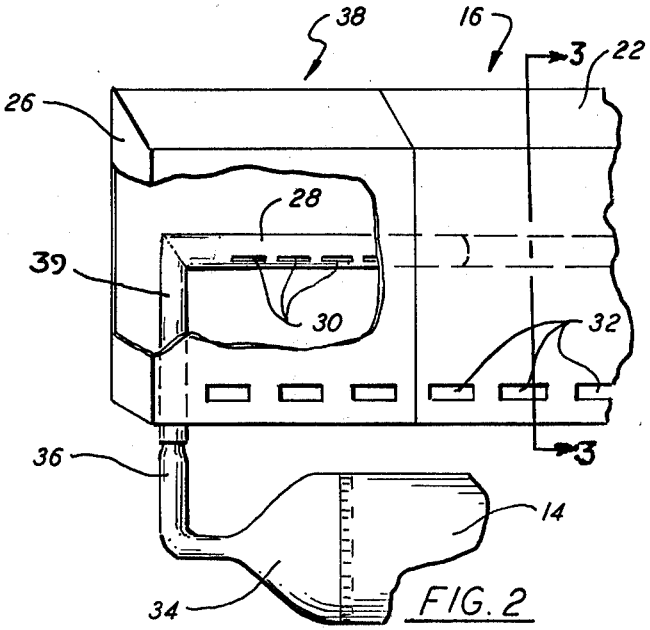
FIG.2 is a fragmentary, front elevational view of elements of the heat distribution system, with portions broken away.

As seen in FIG. 2, a reducing adapter including reducing section 34 and tubular section 36 provides communication between duct 14 and conduit 28. Section 34 is of proper diameter at its open end for mating with the end of duct 14, preferably with a silicone or other appropriate sealant therebetween to minimize heat loss. Tubular section 36 is preferably of somewhat flexible material, such as PVC tubing, to allow its use in varying configurations and lengths between ducts 14 and manifolds 16. The standard sections of manifold 16 are provided with open ends and terminated with an end cap 38 of considerably shorter length, having an end wall 26. The free end of tubular section 36 is inserted in or otherwise joined to the open, downwardly extending portion 39 of conduit 28 within end cap 38 with suitable packing or sealants to render the connection substantially air tight.

Figure 2A:
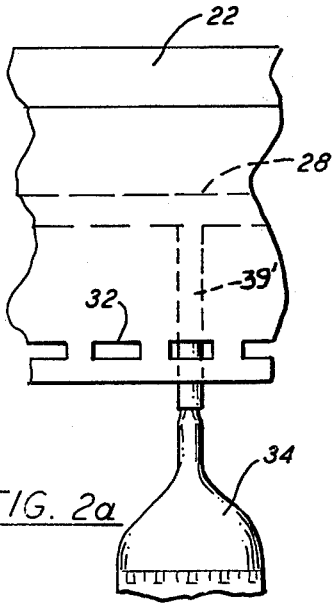
FIG. 2*a* is a fragmentay, front elevational view of an alternate construction of portions of the FIG. 2 elements.

In order to allow installation of the heat distribution system of the invention with maximum ease in association with existing ductwork, units such as that shown in FIG. 2A are provided. Where an existing hot air duct is positioned with its outlet at an intermediate point along a wall, a manifold section having a downwardly extending portion 39', communicating with conduit 28 at a T-connection, is used rather than an end cap 38. The reducing adapter connects duct 14 with portion 39' of the heat distribution conduit in the same manner as the FIG. 2 construction.

Figure 4:
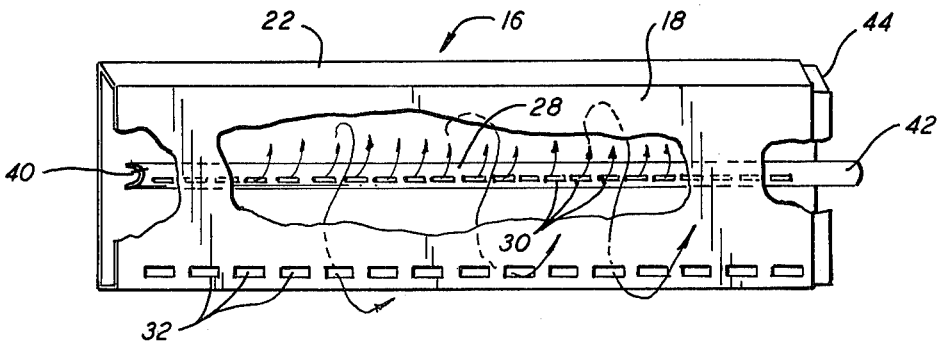
FIG. 4 is a front perspective view of a section of the distribution apparatus with portions broken away to show the flow of heated air therethrough.
Figure 5:
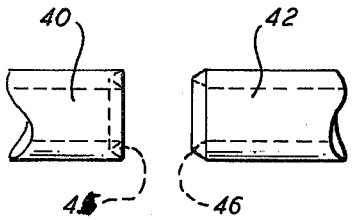
FIG. 5 is an enlarged, front elevational view of fragmentary portions of an element of the apparatus, showing the preferred means for joining adjacent sections.
Figure 6:
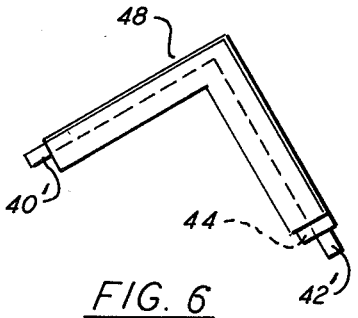
FIG. 6 is a top plan view of a corner unit of the distribution apparatus.

Turning now to FIGS. 4–6, the manner of joining adjacent sections of heat manifolds 16 and conduits 28 is shown in more detail. One end 40 of conduit 28 associated with each section of the manifold is recessed a short distance within the enclosed space defined thereby. The other end 42 extends a corresponding distance outwadly from the end of the manifold. Also, a short sleeve section 44 having outside dimensions equal to the inside dimensions of manifold 16 extends outwardly from one end of each manifold section for insertion in the open end of the adjacent section, preferably with a suitable sealant providing a substantially air tight bond between the two.

As shown in FIG. 5, the end walls of recessed end portions 40 are formed with a V-shaped notch 45 therein and outwardly extending portions 42 are formed with a mating V-shaped ridge 46. Thus, as adjacent manifold sections are joined the abutting conduit ends will be securely engaged, also with the help of a sealant. In FIG. 6 is shown inside corner unit 48 having integral portions arranged at 90° for joining sections of manifold 16 which extend along perpendicular walls in the same manner. It will be noted that both end portions 40' and 42' of the corner manifold unit extend outwardly. This is to allow mating of section 40' with the conduit of an adjoining manifold section 16 which has been cut to fit the remaining space after installation of the maximum number of standard length sections. End portion 40' is larger than conduit 28 so as to fit over the conduit, which has been trimmed flush with the end of the manifold section adjoining the end cap, and be sealed thereto. In addition to the inside corner unit shown, a reversed unit is provided for outside corners, as well as units wherein two portions are angularly disposed at their top and bottom edges in order to join sections at the top and bottom of stairways. The angular arrangement of such sections is equal to the standard stair riser angle in most structures.

Figure 7A:
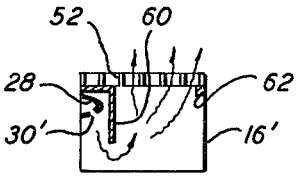
FIG. 7*a* is an end elevational view in section on the line *7a*—*7a* of FIG. 7.
Figure 7:
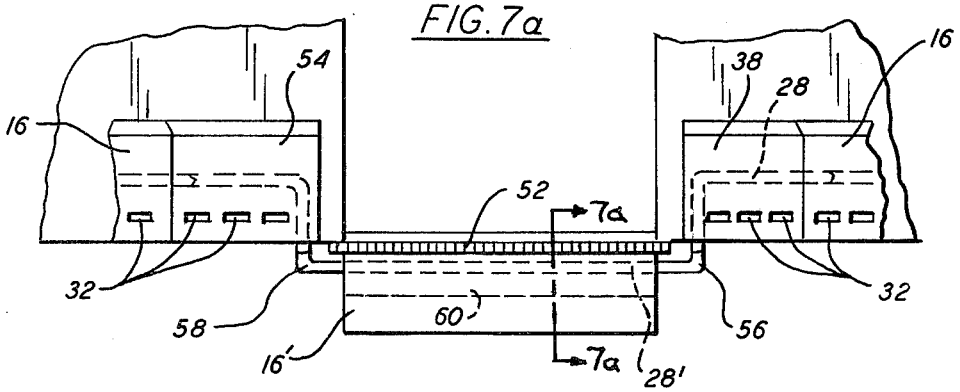
FIG. 7 is a fragmentary, front elevational view showing the preferred means of routing the distribution system around doors or similar openings.

Although manifolds 16 may be terminated at each side of doors or other openings extending substantially to floor level in a wall along which the manifold extends, it is preferred that continuity remain intact. A preferred means of providing such continuity is shown in FIGS. 7, and 7*a*. Doorway 50 is interposed in wall 10 and open grille or register 52 is placed in an opening formed in floor 12 for such purpose. A special section 16' of manifold having end walls on both ends with portions of conduit 28' extending outwardly therefrom. The manifold on the right side of doorway 50 is terminated with end cap 38, as shown in FIG. 2, and that on the left side is terminated by an identical but reversed end cap 54. Flexible tubing 56 and 58 provides communication between the extending ends of conduit 28' and the ends of the conduits extending downwardly from end caps 38 and 54, respectively, again with the use of a sealant.

As shown in FIG. 7A, conduit 28' extends along a vertical wall of manifold 16' and includes the previously described spaced, elongated openings 30' for passage of hot air from conduits 28' into manifold 16'. Baffle 60 extends over conduit 28' and downwardly, parallel to the vertical walls of manifold 16' to direct the hot air into the lower part of the manifold before it rises through register 52. The latter is supported upon baffle 60 and a longitudinally extending support 62 affixed to the inside of conduit 16'. Continuity of the baseboard units on each side of door opening 50 is thus preserved, as well as providing a curtain of warm air at the door opening.

Operation of the system to provide a curtain of warm air adjacent each wall along which manifolds 16 are installed should be apparent from the foregoing description. The baseboard enclosures act as a reservoir for hot air from the central heating system which passes in the conduits running continuously through the enclosures. Individual sections may be standardized and thus economically mass-produced, while remaining adaptable to a wide variety of existing hot air heating systems.

What is claimed is:

1. A system for distributing hot air from a central heating plant to one or more rooms, said system comprising:

(a) a plurality of baseboard heat distribution units arranged in continuous, side-by-side relation against each outside wall of the room to be heated, each of said units including:

(i) an elongated, hollow enclosure having front, back, top and bottom walls and open ends;

(ii) said enclosure front wall including at least one first opening near said enclosure bottom all representing the sole means through which said enclosure communicates with the room to be heated, said first opening representing a substantial portion of the length of said enclosure;

(iii) a generally tubular conduit attached to the inner surface of one of said front and back walls and extending longitudinally of said enclosure between a first terminal end spaced inwardly of one open end of said enclosure and a second terminal end extending outwardly from the other open end of said enclosure, said conduit being a small fraction of the cross section of said enclosure;

(iv) said open ends of said enclosure including portions adapted for mating engagement with adjacent enclosure ends on each side, and said first and second terminal ends of said conduit including means for mating in sealed engagement the first terminal end of one unit with the second terminal end of an adjoining unit;

(v) said conduit including at least one second opening through which said conduit communicates with the interior of said enclosure, said second opening representing a substantial portion of the length of said conduit and being arranged at a vertical level substantially above said first opening, whereby warm air passing through said second opening rises within said enclosure before passing through said first opening;

(b) duct means for receiving hot air from the central heating plant;

(c) means connecting said duct means with said conduit of at least one of said plurality of units for direct transmission of hot air from said duct means to the interior of said conduit, and thence through said second opening to the interior of said enclosure and through said first opening to the room to be heated;

(d) said conduit and enclosures of each of said units being connected for direct communication with the conduit and enclosures, respectively, of adjoining units in a continuous path; and (e) an intermediate unit installed below floor level of the room being heated and having an intermediate enclosure defined by front, back, side and bottom walls and an open grille-work top substantially flush with the floor, an intermediate conduit extending from end to end of said intermediate enclosure and having at least one opening through which the interior of said intermediate conduit communicates with the interior of said intermediate enclosure, and means connecting the ends of said intermediate conduit to the ends of said conduits of adjacent units above floor level on each side thereof for communication in a direct, continuous path.

2. The invention according to claim 1 wherein said conduit extends along a straight axis approximately midway between said enclosure top and bottom walls.

3. The invention according to claims 1 or 2 wherein said first and second openings each comprise a plurality of spaced openings extending in a line along the entire length of said enclosures and conduit, respectively.

4. The invention according to claim 1 wherein said duct is connected with said conduit means at a point intermediate of the ends thereof.

5. The invention according to claim 1 wherein one of said units includes first and second portions arranged at a 90° angle for installation in a corner of the room to connect units along adjacent sides of the room in a continuous path.

6. The invention according to claim 1 wherein said intermediate conduit comprises a tubular member affixed to said intermediate enclosure back wall near the top thereof, and further including baffle means extending in covering relation to the top of said tubular member and in spaced relation along the front side thereof, to direct air exiting said intermediate conduit opening downwardly within said intermediate enclosure prior to exiting through said open grillework top thereof.

7. The invention according to claim 1 wherein said conduit is of significantly smaller cross section than said duct means, and further including a reducing adapter connecting the outlet end of said duct means with said conduit.

* * * * *